US007665514B2

(12) United States Patent
Patterson

(10) Patent No.: US 7,665,514 B2
(45) Date of Patent: Feb. 23, 2010

(54) DRILL STEM GUIDE AND WRENCH APPARATUS

(76) Inventor: William N. Patterson, P.O. Box 1309, Montrose, CO (US) 81402

( * ) Notice: Subject to any disclaimer, the term of this patent is extended or adjusted under 35 U.S.C. 154(b) by 188 days.

(21) Appl. No.: 11/652,273

(22) Filed: Jan. 11, 2007

(65) Prior Publication Data

US 2008/0169129 A1 Jul. 17, 2008

(51) Int. Cl.
*E21B 19/18* (2006.01)

(52) U.S. Cl. ..... 166/77.51; 166/379; 81/57.19

(58) Field of Classification Search ..... 166/380, 166/379, 77.53, 77.51; 173/37; 414/22.71; 81/57.19, 57.2, 57.34, 57.21, 57.39, 57.24
See application file for complete search history.

(56) References Cited

U.S. PATENT DOCUMENTS 3,508,619 A 4/1970 Huffman
3,692,124 A 9/1972 Kimber et al.
3,917,005 A 11/1975 Cannon et al.
4,326,435 A * 4/1982 Guillot et al. ..... 81/57.34
4,478,291 A 10/1984 Futros
5,050,688 A 9/1991 Patterson
5,996,444 A * 12/1999 Pearce et al. ..... 81/57.19
6,082,225 A * 7/2000 Richardson ..... 81/57.16
7,023,199 B2 4/2006 Blubaugh et al.
7,062,991 B1 * 6/2006 West et al. ..... 81/57.16
2002/0189804 A1 * 12/2002 Liess et al. ..... 166/77.51
2007/0068669 A1 * 3/2007 Lesko ..... 166/77.51

OTHER PUBLICATIONS

International Preliminary Report on Patentability issued Jul. 14, 2009 in PCT/US2008/000319.

* cited by examiner

*Primary Examiner*—Jennifer H Gay
*Assistant Examiner*—Cathleen R Hutchins
(74) *Attorney, Agent, or Firm*—Gardere Wynne Sewell LLP

(57) ABSTRACT

A drill stem centralizer and/or breakout wrench includes a frame with opposed hydraulic cylinder actuators mounted on the frame and engaged in with jaw support members for movement toward and away from each other for centralizing or breakout of drill stem sections. The hydraulic actuators are mounted on trunnions which are supported by bearing caps which may be indexed to change the spacing of the opposed actuators to accommodate a wide range of drill stem diameters or cross-sectional shapes. The jaw support members are provided with laterally spaced guide parts which are moveable in slots in the frame to guide the jaw support members for linear reciprocal movement in response to actuation by the hydraulic actuators. The frame may be mounted for limited rotation on a feed beam to effect drill stem breakout operations.

13 Claims, 4 Drawing Sheets

DRILL STEM GUIDE AND WRENCH APPARATUS

BACKGROUND OF THE INVENTION

In the art of drilling equipment there has been a longstanding need for improvements in drill stem guides or so-called centralizers. Drill stem guides or centralizers are typically mounted on the distal end of a drill feed-beam or mast for supporting and guiding elongated drill stem sections, such as drill pipe, drill rods and the like. One problem associated with prior art drill rod centralizers or guides is the lack of ability to accommodate drill stems of a wide range of diameters. This problem is also present with respect to so-called breakout wrenches which assist in coupling and, primarily, uncoupling sectional drill stem members.

Accordingly, the present invention is directed to solving problems associated with prior art drill rod guides or centralizers and also prior art drill rod or drill stem breakout wrenches and the like.

SUMMARY OF THE INVENTION

The present invention provides an improved drill stem guide or centralizer apparatus. The present invention also provides an improved drill rod or drill stem breakout wrench.

In accordance with one important aspect of the invention, a drill stem centralizer or breakout wrench is provided which accommodates a wide range of diameters of sectional drill stem members, such as rod or pipe, and may be easily converted from accommodating a first predetermined range of drill pipe or drill rod diameters to a second range of drill pipe or drill rod diameters. The centralizer or breakout wrench of the present invention also includes hydraulic actuators, preferably cylinder and piston type actuators, for moving the drill pipe or drill rod guide jaw members or gripping members between working positions and positions which allow insertion of or removal of drill stem sections with respect to the drill stem or so called drill string. The hydraulic actuators are mounted on trunnions which are supported in spaced apart bearing caps which have eccentric trunnion bearing bores. The caps may be reversed with respect to their working positions supported on a frame of the centralizer or breakout wrench to extend the working range of the actuators and the guide members or gripping members which are engageable with or are operable to be disposed in close proximity to the drill stem.

In accordance with another aspect of the present invention, drill stem guide or centralizer and drill stem breakout wrench is provided which includes improved guide or wrench jaw support members which are supported for reciprocal linear movement on the centralizer or breakout wrench frame between working positions and retracted positions.

In accordance with yet another aspect of the present invention, a drill stem centralizer and/or drill stem breakout wrench is provided which utilizes a substantial number of common parts, is compact in its overall configuration and may be configured such that a centralizer version of the apparatus may be disposed directly adjacent to and in partial supportive relationship to a breakout wrench version of the apparatus.

Those skilled in the art will further appreciate the above mentioned advantages and superior features of the invention together with other important aspects thereof upon reading the detailed description which follows in conjunction with the drawings.

DETAILED DESCRIPTION OF PREFERRED EMBODIMENTS

Figure 1:
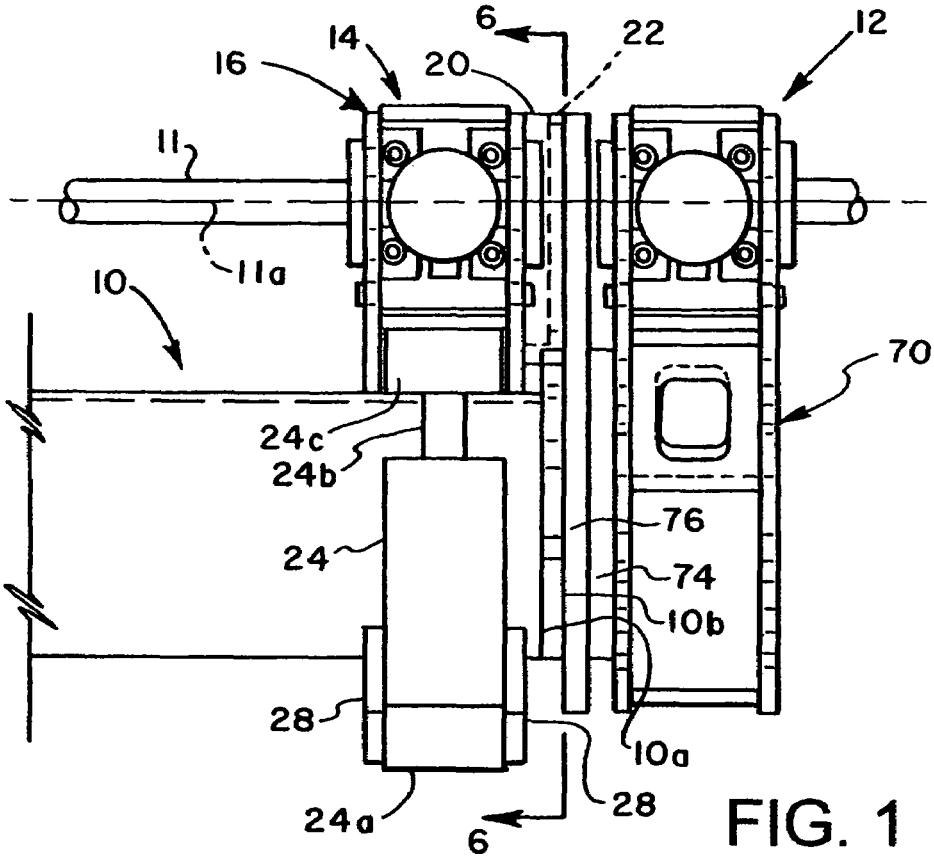
FIG. 1 is a side elevation of a portion of a drilling apparatus feed beam showing a centralizer or guide apparatus and a breakout wrench apparatus mounted thereon and in accordance with the present invention.

In the description which follows like parts are marked throughout the specification and drawing with the same reference numerals, respectively. The drawing figures are not necessarily to scale and certain features may be shown exaggerated in scale or in somewhat generalized or schematic form in the interest of clarity and conciseness.

Referring to FIG. 1, there is illustrated apparatus in accordance with the present invention mounted on the distal end of an elongated drill apparatus feed beam, generally designated by the numeral 10. The feed beam 10 may be of a type disclosed and claimed in my U.S. Pat. No. 5,050,688 issued Sep. 24, 1991 for a drilling apparatus utilizing percussion drilling equipment. Those skilled in the art will recognize that the invention described and claimed herein may also be used in conjunction with drill stems which are primarily of the rotary type, as compared with the type typically used in hardrock percussion drilling, for example. The apparatus of the present invention includes a centralizer only version of the apparatus, also known as a drill stem guide, and generally designated by the numeral 12, FIGS. 1 and 2. The drill stem guide or centralizer apparatus is suitably mounted on the distal end 10*a* of the feed beam 10. An adaptor plate 10*b* is disposed between additional structure to be described and associated with the apparatus 12 and the distal end 10*a* of feed beam 10. Also mounted on the feed beam 10 is a so-called breakout wrench version of the invention, generally designated by the numeral 14. The centralizer 12 and the breakout wrench 14 utilize a substantial number of common parts and the breakout wrench 14 may also function as a drill stem guide or centralizer, if desired, for guiding or centralizing a drill stem 11 and sections thereof.

Figure 2:
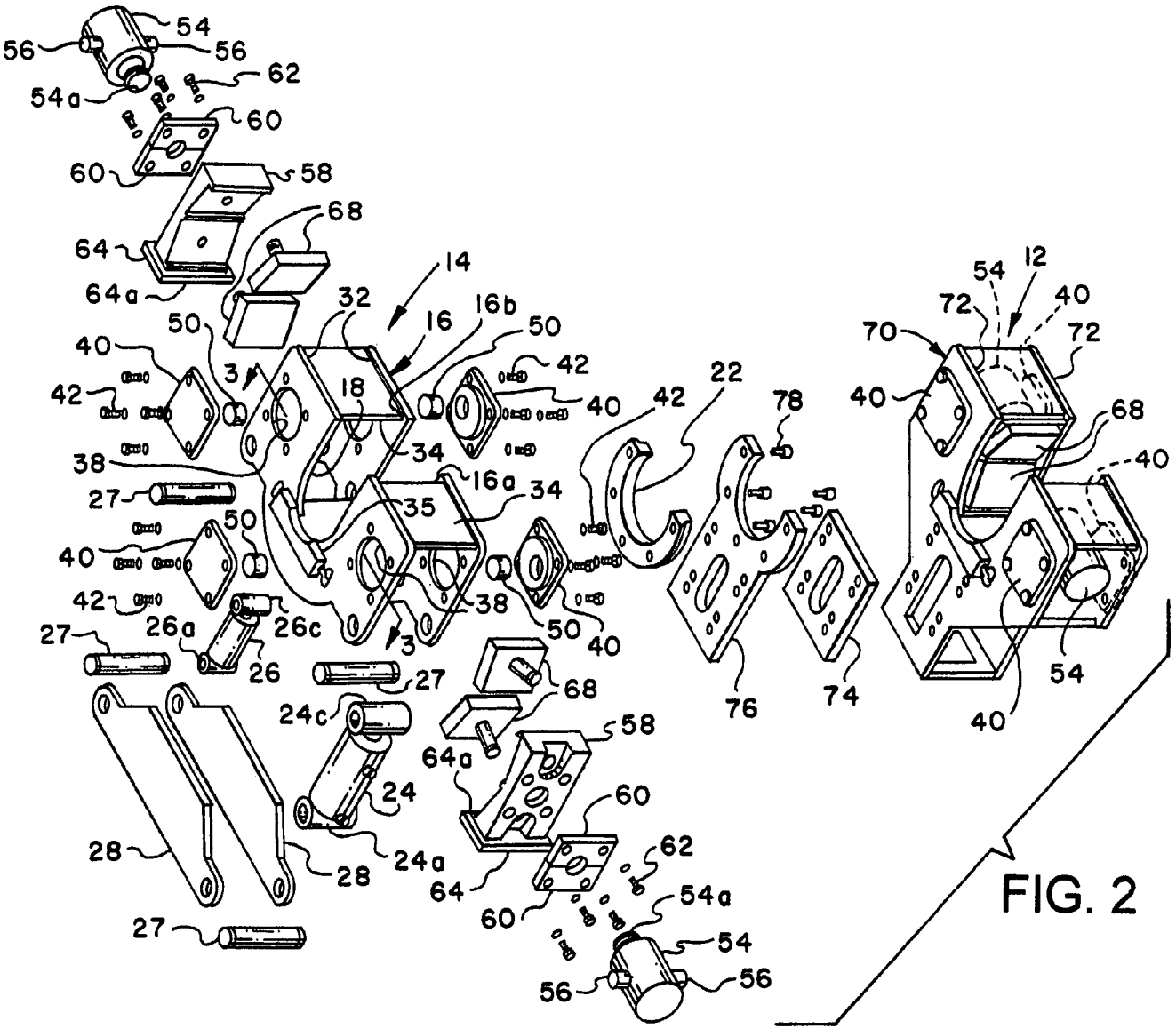
FIG. 2 is an exploded perspective view of the components of the apparatus illustrated in FIG. 1.
Figure 6:
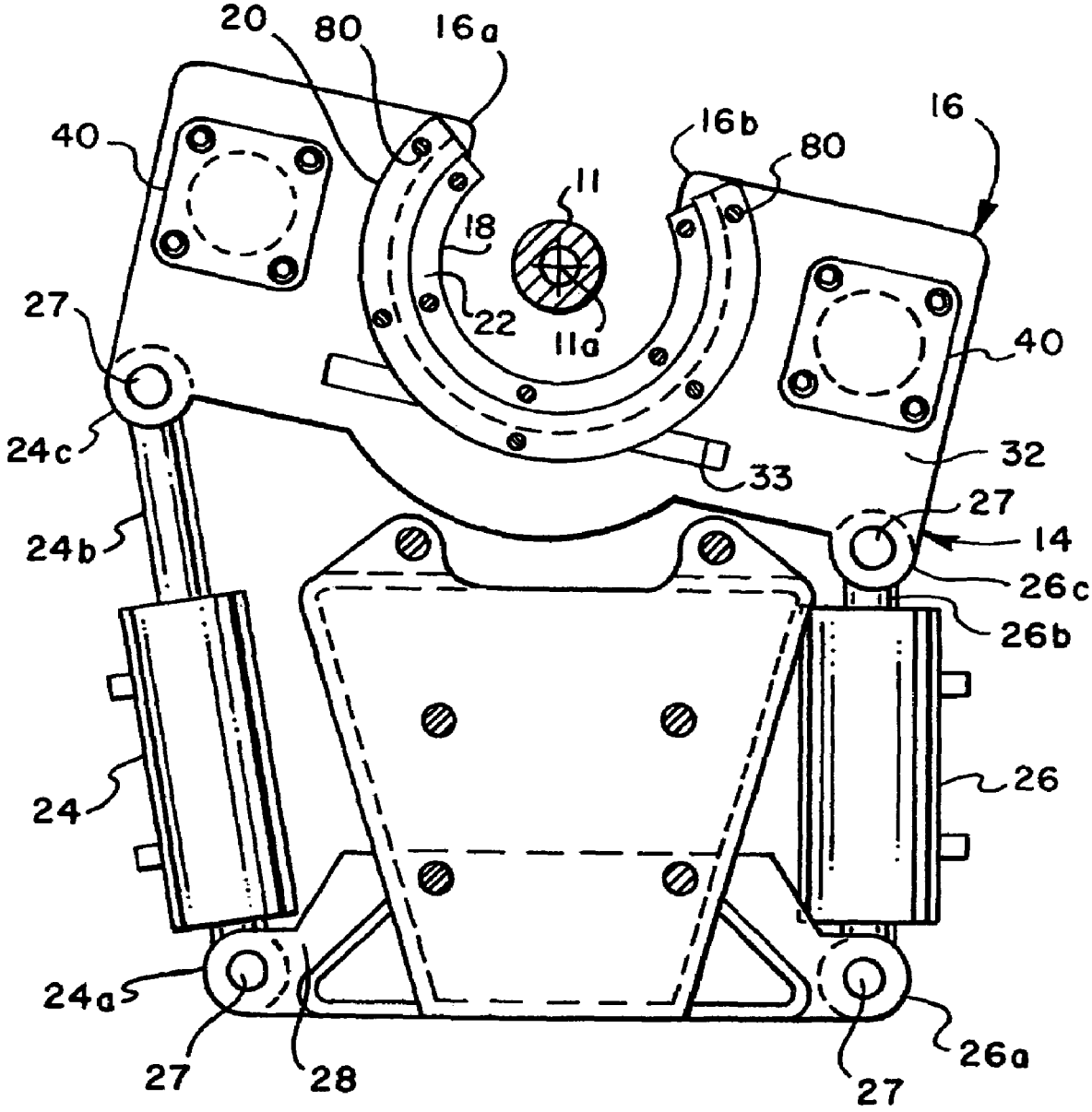
FIG. 6 is a view taken generally along line 6-6 of FIG. 1 and illustrating a preferred arrangement for supporting the breakout wrench frame.

Referring briefly to FIGS. 1 and 6, centralizer and breakout wrench 14 includes a frame 16 having an arcuate opening 18, FIGS. 2 and 6, which is delimited by opposing corners 16*a* and 16*b* of frame 16 to allow insertion of and removal of a drill stem or drill stem section with respect to the wrench or centralizer, if desired. An arcuate collar 20 is supported on frame 16, FIG. 6, and is co-operable with a bearing ring 22, FIGS. 2 and 6, for supporting the frame 16 for limited rotation about an axis 11*a*, FIG. 6 which axis is the central longitudinal axis of drill stem 11. Accordingly, centralizer and/or breakout wrench 14 may be supported at least partly by centralizer 12 and by feed beam 10 as may be described in further detail herein.

Centralizer or breakout wrench 14 is also supported by and moveable by spaced apart hydraulic cylinder and piston actuators 24 and 26, FIG. 6, which include respective cylinder end bosses 24*a* and 26*a* connected to spaced apart support plates 28 which are suitably supported on feed beam 10, FIGS. 1, 2 and 6. Bosses 24*a* and 26*a* journal respective bearing pins 27, FIG. 2, which are supported directly by the spaced apart support plates 28. Actuator piston rods 24*b* and

26*b*, FIG. 6, of the respective actuators 24 and 26, are connected at their distal ends to the frame 16 by respective pivot pins 27 also, see FIGS. 2 and 6.

Piston rods 24*b* and 26*b* terminate in respective transverse tubular bosses 24*c* and 26*c*, FIGS. 2 and 6. Pressure fluid operated actuators 24 and 26 may be suitably controlled to provide for limited rotation of the frame 16 about the axis 11*a* in opposite directions for breaking loose connections between sections of drill stem 11 or tightening connections between sections of a drill stem, such as drill stem 11. As shown in FIG. 6, the centralizer or breakout wrench 14 is in a position where actuator 24 has its piston rod 24*b* substantially fully extended while actuator 26 has its piston rod 26*b* essentially fully retracted. The opposite condition, may take place by extending the piston rod of actuator 26 while retracting the piston rod of actuator 24 to rotate the wrench frame 16 in a counter-clockwise direction, viewing FIG. 6.

Figure 5:
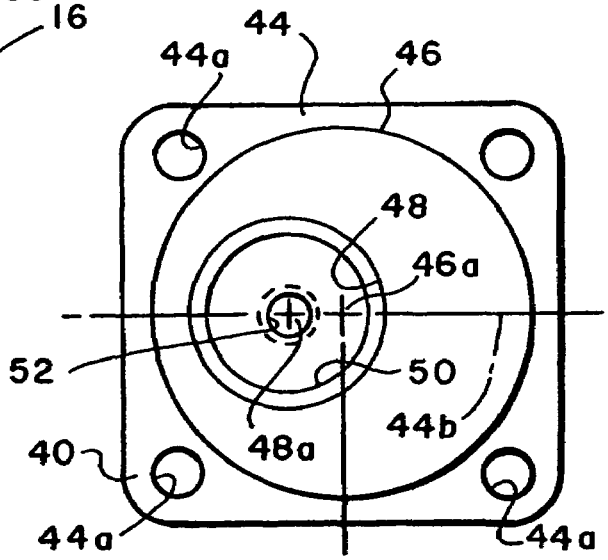
FIG. 5 is a plan view of one of the trunnion support caps for the actuators of the apparatus of the invention.
Figure 3:
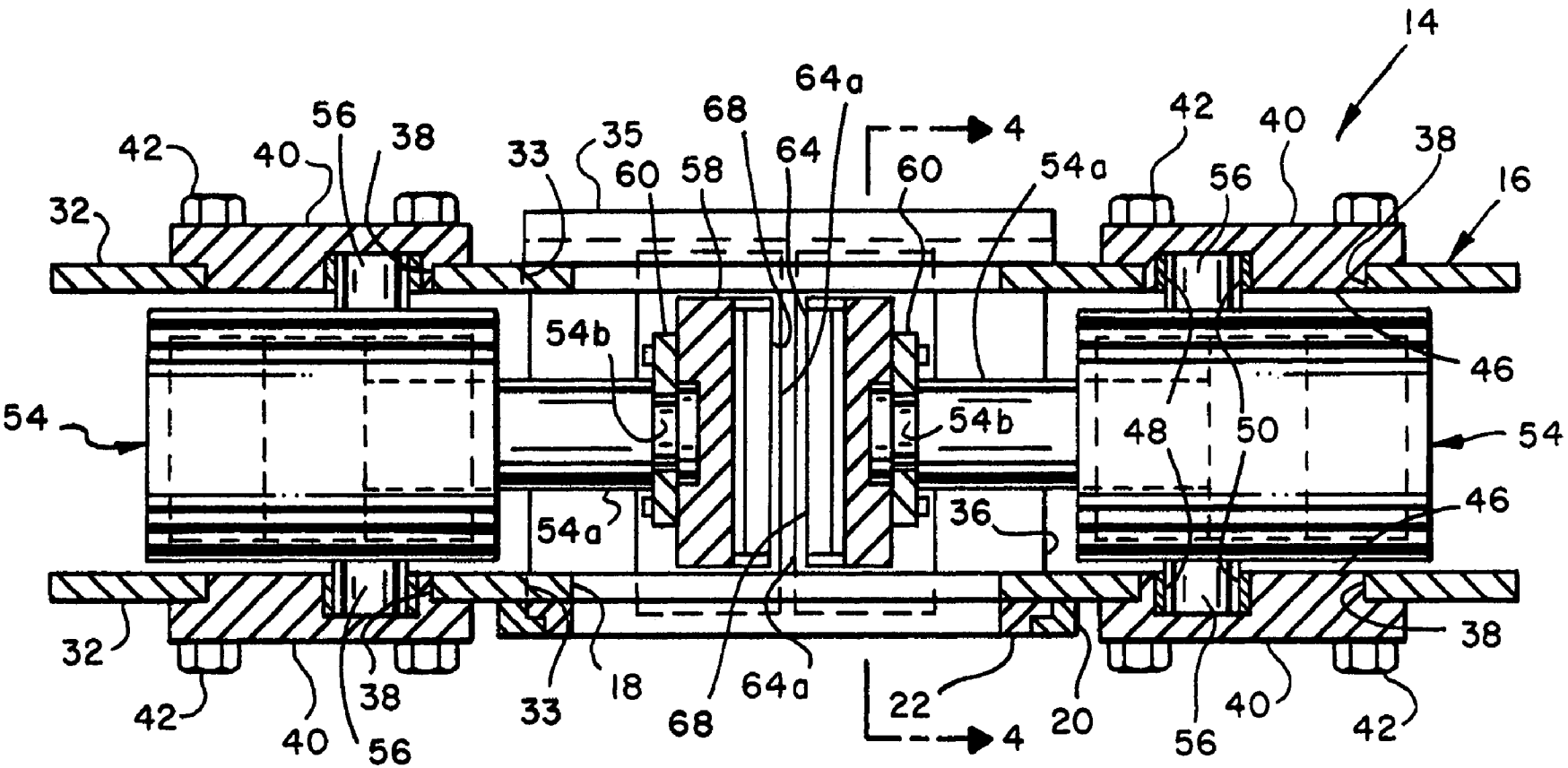
FIG. 3 is a section view of the assembled breakout wrench apparatus illustrated in FIG. 2 and is taken along the line 3-3 of FIG. 2.

Referring now primarily to FIGS. 2 and 3, the frame 16 of centralizer and breakout wrench 14 comprises spaced apart frame plates 32 which may be essentially identical in construction. Frame plates 32 are interconnected by transverse frame plates 34 and 36, as shown in FIGS. 2 and 3. Frame plates 32 are provided with spaced apart cylindrical bores 38 which are operable to receive selectively positionable trunnion bearing cap members 40 which are removably secured to the frame plates by suitable threaded fasteners 42, as shown in FIGS. 2 and 3. Trunnion bearing caps 40 each include a generally rectangular or square base part 44 and a cylindrical boss part 46 having an eccentric bore 48 formed therein which may support a removable ring bearing member 50, see FIG. 5. Base part 44 is provided with suitable spaced apart fastener receiving bores 44*a*, FIG. 5. A threaded bore 52, FIG. 5, may be provided for receiving a lubricant fitting or the like, not shown. The central axis 48*a* of bore 48 is spaced from central axis 46*b* of boss 46 along a centerline 44*b* which is equidistant from two of bores 44*a*, FIG. 5.

Figure 4:
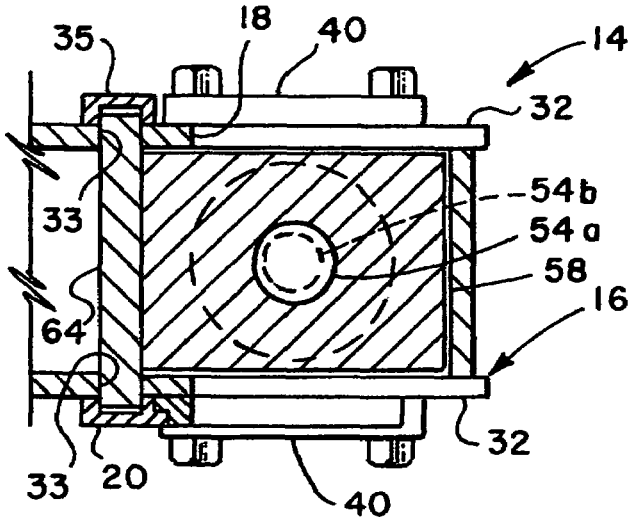
FIG. 4 is a transverse section view taken generally along the line 4-4 of FIG. 3.

Referring further to FIGS. 2 and 3, each pair of opposed bearing caps 40 support a hydraulic cylinder and piston type actuator 54, which actuator is provided with opposed, generally cylindrical trunnions 56, see FIG. 3. Trunnions 56 are adapted to be supported for limited pivotal movement in bearing rings 50 and supported by the bearing caps 40, as shown in FIG. 3. Actuators 54 include linearly extensible piston rods 54*a* which are each suitably connected to respective centralizer or wrench jaw support members 58. Piston rods 54*a* include a reduced diameter cylindrical groove 54*b* which receives respective adjacent connector plates 60. Plates 60 are connected to the jaw support members 58 by suitable fasteners 62, FIG. 2. Jaw support members 58 include a generally planar rectangular guide part 64 integrally formed therewith for guiding the jaw support members for linear reciprocation toward and away from each other between the frame plates 32. Guide parts 64 are disposed within opposed, elongated linear slots 33, see FIG. 4, formed in the respective frame plates 32. Slots 33 may be covered by an elongated slotted cover member 35 and a part of collar 20, see FIG. 4, both of which may be removably mounted on the respective frame plates 32.

The jaw support members 58 are adapted to support removable jaw members 68, see FIG. 2, which jaw members may be interchanged with other jaw or bearing members, depending on the diameter and cross-sectional geometry of the drill stem being guided or to be gripped for drill stem section connecting and/or disconnecting operations. Moreover, the jaw support members 58 may be dimensioned such that opposed cooperating edges 64*a* of the guide parts may engage each other, see FIG. 3 also, to limit movement of the jaws or guide members 68 toward each other when the respective actuators 54 have been actuated to extend their piston rods 54*a*. In this way, when the apparatus 14 is being used as a centralizer the jaws or guide members 68 will not forcibly engage the drill stem but will loosely journal the stem sufficiently for centralizing or guiding operations. Conversely, the jaw support members 58 may be configured such that the guide parts 64 are dimensioned so that they will not engage each other before the jaws 68 forcibly engage a drill stem. Accordingly, the apparatus 14 may also function as a breakout wrench by forcible engagement of the jaws 68 with a drill stem when the cylinder actuators 54 are energized to extend their respective piston rods.

As discussed previously, a major advantage of the apparatus 14 is the ability to handle drill stems of a wide range of diameters. For example, if relatively large diameter drill stems are being used in conjunction with the apparatus 14 the trunnion bearing caps 40 may be removed from their working positions shown in FIG. 3 and rotated 180° so that the respective pairs of bores 48 on opposite sides of axis 11*a* are spaced farther apart than as shown in FIG. 3. Thus, the actuator piston rods 54*a* and the jaw support members 58 may be retracted further away from each other to accommodate larger diameter drill stems or similar elongated members being worked by the apparatus 10. Accordingly, a versatile drill stem centralizer and/or breakout wrench is provided by the present invention.

Referring further to FIGS. 1 and 2, the centralizer apparatus 12 is configured to be substantially like the apparatus 14 in many respects and includes a frame 70 formed by spaced apart frame plates 72 configured similar to the frame 16. Frame plates 72 are adapted to support trunnion bearing caps 40 in the same manner as the frame plates 32 of the frame 16 and are configured for supporting opposed actuators 54 and respective jaw support members, also in the same manner as the configuration of the apparatus 14. However, the frame 70 is configured to be fixed to the distal end of the feed beam 10 rather than rotatable about the axis 11*a* for wrenching operations, as is the case for the apparatus 14.

In the arrangement shown in FIG. 1, where the guide or centralizer apparatus 12 is mounted on the distal end 10*a* of the feed beam 10 adjacent to the centralizer and/or breakout wrench 14, a first adapter plate 74 is interposed the frame 70 and a second adapter plate 76. Adapter plate 76 is configured to support the bearing collar 22 using conventional mechanical sockethead screw fasteners 78 for example, see FIGS. 2 and 6 also. Accordingly, the bearing collar 22 is fixed with respect to the feed beam 10 and supports the frame 16 for limited rotation about the axis 11*a* in response to energization of the actuators 24 and 26, as previously described. As also previously described, the arcuate bearing collar 20 is also releasably secured to one of the frame plates 32 by mechanical fasteners, such as sockethead screws 80, FIG. 6. Additional mechanical fasteners are of course utilized to secure the centralizer 12 to the end 10*a* of the feed beam 10 by, for example, threadedly connecting the centralizer 12 to the feed beam end plate 10*b* with the adapter plates 74 and 76 sandwiched between the frame 70 and the end plate.

The construction and operation of the apparatus 12 and 14 is believed to be understandable to those of ordinary skill in the art based on the foregoing description. Utilization of the guide or centralizer and breakout wrench apparatus 14 alone may be suitable for certain applications. Typically, a drill stem 11 may be centralized by providing jaw support members 58 with guide plates 64, each having a surface 64*a* engageable with a cooperating surface 64*a* of the opposing jaw support member to limit movement of the jaws 68 toward each other whereby a drill stem may be centralized, depending on the diameter thereof.

Additionally, for drill stems which have external or large diameter couplings, such couplings may be gripped by the jaws 68 before the jaw support members engage each other when the actuators 54 have been actuated to extend their respective piston rods 54*a* toward each other. Of course, if the diameter or cross-sectional shape of the drill stem being used with a drilling system incorporating the apparatus 14 is larger than can be handled by positioning the trunnion bearing support caps close together, one or both of a set of caps supporting an actuator 54 may be rotated 180° and resecured to the respective frame plates 32 thereby placing the actuators 54 farther apart and allowing for accommodation of larger diameter drill stem members. Taking into consideration the harsh operating environment of earth drilling apparatus, including the apparatus 12 and the apparatus 14 described herein, the configuration of the jaw support members and their guidance on the frames 16 and 70 is also advantageous.

Conventional engineering materials may be utilized to construct the apparatus 12 as well as the apparatus 14 while using conventional hydraulic cylinder and piston assemblies at least modified to provide the trunnions 56, for example.

Although preferred embodiments of the invention have been described in detail herein, those skilled in the art will recognize that various substitutions and modifications may be made without departing from the scope and spirit of the appended claims.

What is claimed is:

1. A drill stem engaging apparatus for connection to an elongated feed beam of a drilling apparatus for one of guiding and wrenching a drill stem, said apparatus comprising:

a frame;

opposed actuators supported on said frame, said actuators comprising pressure fluid operated piston and cylinder actuators;

spaced apart jaw support members connected to said actuators for movement toward and away from each other to engage a drill stem and to move away from said drill stem;

actuator support members for said actuators disposed on said frame and adapted to position said actuators in one of at least two selected positions to accommodate a range of one of diameter or cross-sectional shape of said drill stem;

wherein said actuators include opposed trunnions engaged with respective bearing bores on said actuator support members; and said actuator support members include a generally cylindrical boss formed thereon and said bearing bores are disposed eccentric to said boss whereby said support members may be disposed relative to said frame in a first position and in a second position rotated 180° from said first position.

2. The apparatus set forth in claim 1 wherein:

said frame is mounted for limited rotation on and with respect to said feed beam.

3. The apparatus set forth in claim 2 wherein:

said frame is connected to at least one actuator for rotating said frame with respect to said feed beam.

4. The apparatus set forth in claim 3 wherein:

said frame is connected to opposed actuators for rotating said frame in opposite directions with respect to said feed beam.

5. The apparatus set forth in claim 1 including:

opposed jaws mounted on respective ones of said jaw support members for engagement with said drill stem.

6. The apparatus set forth in claim 1 wherein:

said frame comprises spaced apart frame plates connected to each other by intermediate frame members, said frame plates including guide means for guiding said jaw support members, respectively, for linear reciprocating movement with respect to said frame.

7. The apparatus set forth in claim 6 wherein:

said guide means comprise opposed slots formed in said frame plates, respectively, for receiving a part of said jaw support members, respectively.

8. The apparatus set forth in claim 7 wherein:

said part of said jaw support member comprises a guide plate receivable in said slots, respectively.

9. The apparatus set forth in claim 1 including:

a second drill stem engaging apparatus mounted on said feed beam including a second frame, opposed actuators mounted on said second frame and engageable with opposed jaw support members operable for movement toward and away from said drill stem.

10. A drill stem engaging apparatus for connection to an elongated feed beam of a drilling apparatus for one of guiding and wrenching a drill stem formed of interconnected sections, said apparatus comprising:

a frame mounted for limited rotation on said feed beam;

opposed pressure fluid actuators supported on said frame;

spaced apart jaw support members supported on said frame and connected to said actuators for movement to engage a drill stem;

actuator support members on said frame and adapted to position said actuators in one of at least two selected positions to accommodate a range of diameters of said drill stem;

opposed frame actuators operable to rotate said frame about an axis of said drill stem to perform drill stem section breakout operations;

wherein said opposed pressure fluid actuators include opposed trunnions engaged with respective bearing bores on said actuator support members; and said actuator support members include a generally cylindrical boss formed thereon and said bearing bores are disposed eccentric to said boss whereby said support members may be disposed relative to said frame in a first position and in a selected second position rotated 180° from said first position.

11. The apparatus set forth in claim 10 wherein:

said frame comprises spaced apart frame plates connected to each other by intermediate frame members, said frame plates including guide means for guiding said jaw support members, respectively, for linear reciprocating movement with respect to said frame.

12. The apparatus set forth in claim 11 wherein:

said guide means comprise opposed slots formed in said frame plates, respectively, for receiving a part of said jaw support members, respectively.

13. The apparatus set forth in claim 12 wherein:

said part of each of said jaw support member comprises a guide plate receivable in said slots, respectively.

* * * * *

UNITED STATES PATENT AND TRADEMARK OFFICE

CERTIFICATE OF CORRECTION

PATENT NO. : 7,665,514 B2
APPLICATION NO. : 11/652273
DATED : February 23, 2010
INVENTOR(S) : William N. Patterson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 231 days.

Signed and Sealed this

Seventh Day of December, 2010

David J. Kappos

David J. Kappos
*Director of the United States Patent and Trademark Office*